US008002924B2

(12) United States Patent
Machamer

(10) Patent No.: US 8,002,924 B2
(45) Date of Patent: Aug. 23, 2011

(54) APPARATUS FOR SPLICING WEBS

(75) Inventor: David E. Machamer, Wauconda, IL (US)

(73) Assignee: Tamarack Products, Inc., Wauconda, IL (US)

( * ) Notice: Subject to any disclaimer, the term of this patent is extended or adjusted under 35 U.S.C. 154(b) by 89 days.

(21) Appl. No.: 12/694,077

(22) Filed: Jan. 26, 2010

(65) Prior Publication Data

US 2010/0186879 A1 Jul. 29, 2010

Related U.S. Application Data

(60) Provisional application No. 61/147,563, filed on Jan. 27, 2009.

(51) Int. Cl.
*B65H 21/00* (2006.01)

(52) U.S. Cl. ..... 156/159; 156/157; 156/504; 156/505; 242/552; 242/553; 242/556.1

(58) Field of Classification Search ..... 156/157, 156/159, 502, 504, 505, 507; 242/551, 552, 242/553, 556.1
See application file for complete search history.

(56) References Cited

U.S. PATENT DOCUMENTS 3,717,057 A * 2/1973 Takimoto ..... 83/98
3,939,031 A * 2/1976 Takimoto ..... 156/505
4,106,974 A * 8/1978 Hirsch ..... 156/504
4,315,794 A * 2/1982 Palmieri ..... 156/504
4,492,609 A * 1/1985 Blom ..... 156/507
5,131,593 A * 7/1992 Siegfried et al. ..... 156/504
5,443,681 A * 8/1995 Stivani et al. ..... 156/504
5,474,252 A * 12/1995 Schmid ..... 242/554.2
5,698,060 A * 12/1997 Long ..... 156/304.3
5,881,964 A * 3/1999 Fujikura et al. ..... 242/556.1
6,881,289 B2 * 4/2005 Borderi et al. ..... 156/159
2004/0129374 A1 * 7/2004 Hebels et al. ..... 156/157
2007/0204950 A1 * 9/2007 Tonohara ..... 156/157

* cited by examiner

*Primary Examiner* — Mark A Osele

(74) *Attorney, Agent, or Firm* — Wildman, Harrold, Allen & Dixon LLP

(57) ABSTRACT

A continuous splicer includes first and second closely spaced rotating cylinders each having a respective cutting element and tape retaining arrangement disposed on its outer periphery. With a depleting web fed by the first cylinder and a replenishing web fed by the second cylinder, an end of the replenishing web is adhesively joined to the depleting web while in motion and the depleting web is severed by the first cylinder's cutting element in forming a splice of the two webs. As the replenishing web depletes, a third web may be inserted on the first cylinder and automatically or manually spliced to the original replenishing web without stopping or re-configuring the splicer. The splicer is capable of delivering the webs at a constant rate or a rapidly changing and/or dynamic cycling rate, and applies relatively low web tension for operation with delicate, narrow and extensible webs.

29 Claims, 15 Drawing Sheets

APPARATUS FOR SPLICING WEBS

RELATED APPLICATION

This application claims the benefit of U.S. Provisional Application No. 61/147,563 filed Jan. 27, 2009 for "APPARATUS FOR SPLICING WEBS".

FIELD OF THE INVENTION

The present invention provides an improved splicing apparatus and method, suitable for handling a wide range of materials, web widths, and web thicknesses. It is particularly suitable for handling relatively delicate webs of paper or poly film material.

BACKGROUND OF THE INVENTION

Summary of prior art splicers: Many of the prior art unwinding (i.e., supplying rather than rewinding) splicers are zero-speed splicers, that is the depleting web is stopped and joined to a prepared, stationary replenishing web. The supply of web to a web consuming device may continue uninterrupted as web is taken from a stored supply of web in a festoon or accumulator. Most of these zero-speed splicers use a cutter that cuts the web with a transverse motion, in a reciprocating cycle.

There are also "flying" splicers and these make a splice by matching the speeds of two webs and then joining them together. These "flying" splicers require costly drive systems and controls.

SUMMARY OF THE INVENTION

The present invention provides an unwind/splicer that delivers a web at continuous, relatively constant rate or rapidly changing and/or cycling, dynamic rate in response to like demand with minimal tension variation.

An unwind/splicer delivers web at relatively low tension to allow handling of delicate, narrow, and or extensible (stretchy) webs such as thin materials like paper or poly and especially narrow width, minimal thickness, i.e., down to about ½ mil (0.0005" or 13 micron) commonly used in windowing operations performed by the Vista™ window applicator made by Tamarack Products Inc, Wauconda, Ill., USA for use on carton folder/gluers, or web finishing systems such as those provided the Versa-Web® machine, also of Tamarack Products Inc.

The invention includes a splicer that makes running splices as opposed to zero-speed splices and, further, does so with minimal effect on web tension. The splicer makes rapid splices thereby consuming a relatively small amount of web from an accumulator. The splicer can be manually, crank-operated or can be equipped for automatic operation. The splicer provides a lap or butt splicer that simultaneously cuts the expiring web while joining the prepared (i.e., pre-taped leading edge), replenishing web. The instant splicer includes a simplified mechanism compared to prior art splicers. It eliminates clamping bars and the complications of prior art sequencing clamping bars with cutting and other operations. Further, the instant splicer is compatible with either two-sided or single-side adhesive splicing tapes, and it uses rotary cutting rather than reciprocating, transverse cutting wheels/blades or shear cutting blades/anvils. The instant splicer uses inexpensive cutting blades, and the blades which are easy to replace.

Twin cylinders locate the cutting blades and vacuum surfaces for securing the tape and leading edge of the replenishing web.

Further, a simple rolling action of the splicing cylinders provides the key functions and sequencing of the splicing operation:

- Supports the splicing tape and lead end of the replenishing web.
- Advances the replenishing web towards the depleting web.
- Rolls the tape and lead end of replenishing web into contact with the depleting web, at an inherently, approximately-matched speed.
- Drives an anvil strip between the depleting web and replenishing web via a simple crank/slider mechanism. The anvil strip provides two functions: one side acts as an anvil surface for cutting the depleting web against, the other side acts as a shield to prevent cutting the replenishing web
- Cuts the depleting web with a rolling motion rather than a reciprocating knife motion.
- Releases the replenishing and depleting webs as splicing cylinders roll out of contact.
- Retracts the anvil strip, again using a simple crank/slider mechanism.

A reciprocating anvil strip is interposed between the cutting cylinders when a cut is needed, and then retracted when it is not needed, and without support by a belt.

In the instant invention, the anvil strip is only interposed between the cylinders when a cut is being effected. And the anvil strip is used in a unique way: One side of the anvil strip serves as a cutting anvil surface for cutting one web. The other side of the anvil strip simultaneously and advantageously protects a second web from being cut.

The reciprocating anvil strip both moves the anvil strip clear of the web while web is consumed by the host machine, and approximately matches the anvil strip velocity with the cutting blade velocity. This reduces wear on both the anvil strip and cutting blade.

The instant invention provides an elegantly simple method of making a 'flying splice' by providing a small amount of 'stored' web to assure that the replenishing web is readily accelerated to approximately the speed of the expiring web and that the leading end of the replenishing web is joined in close proximity to the cut tail end of the expiring web. This eliminates the need for sophisticated controls and drives for matching the speed of the webs during the splice. The instant invention simply has a small amount of slack web without the guiding and controlling mechanism of some prior art devices.

BRIEF DESCRIPTION OF THE DRAWINGS

The appended claims set forth those novel features which characterize the invention. However, the invention itself, as well as further objects and advantages thereof, will be best be understood by reference to the following detailed description of a preferred embodiments taken in conjunction with the accompanying drawings, where like reference characters identify like elements throughout the various figures, in which;

DETAILED DESCRIPTION OF THE INVENTION

Figure 1:
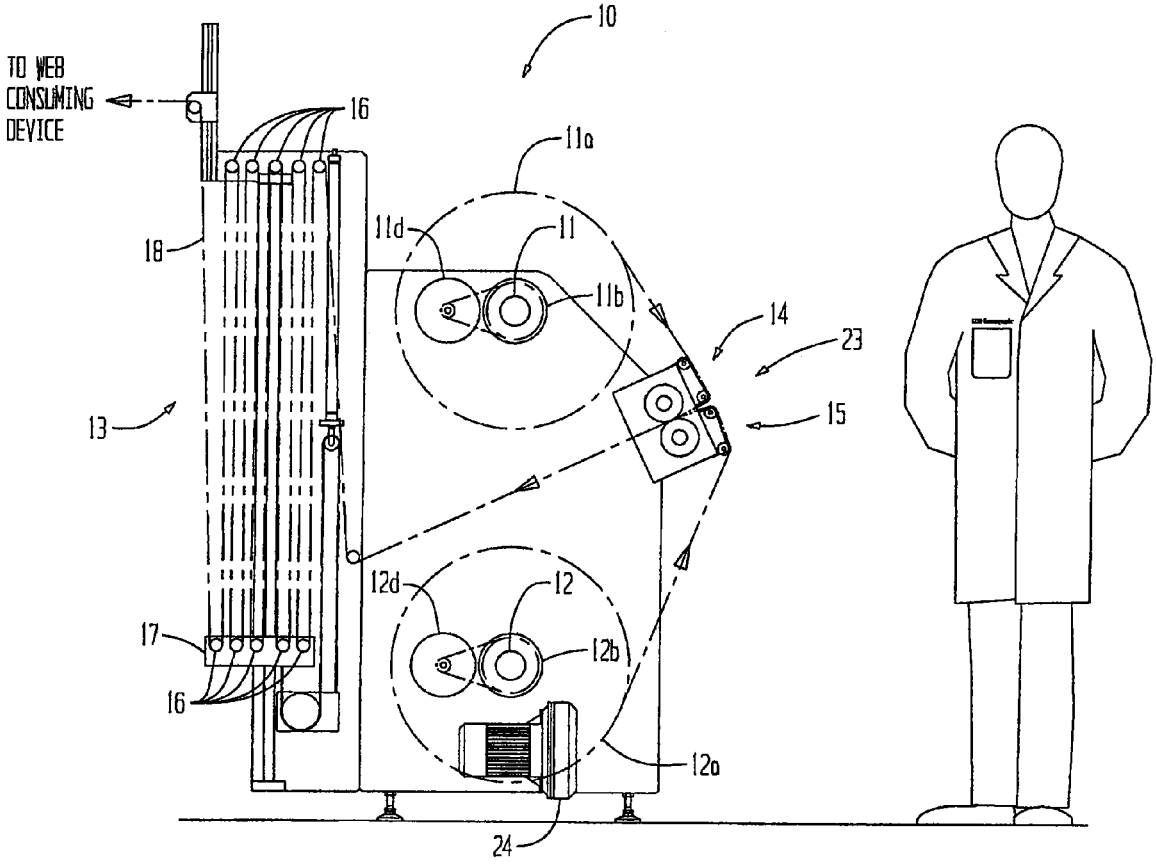
FIG. 1 is a simplified schematic illustration of a web supply arrangement incorporating the continuous web splicer of the present invention.

A web unwinding and splicer apparatus 10, shown in FIG. 1 illustrates a general configuration, including roll unwind spindles 11 and 12, and accumulator 13 supported by conventional frame work. The apparatus 10 also includes mirror-image splicing heads 14 and 15 as part of a splicing apparatus 23. The splicing heads 14 and 15 are configured to provide a novel and inventive rolling splicing process, as will be disclosed herein.

In operation, one of the spindles 11 or 12 is supplying web 18 to the accumulator 13 and in turn, supplies the web 18 to whatever web consuming machinery the apparatus 10 is connected to, such as a Vista® window applicating machine manufactured by Tamarack Products Inc. of Wauconda, Ill. For example, spindle 11 is supplying web 18 from a roll of web material 11*a* and roll 11*a* will eventually be depleted. Splicing head 15 is prepared with the lead end of a replenishing roll 12*a* on spindle 12. When roll 11*a* is nearly depleted, the splicing mechanism 23 splices web material from roll 12*a* on spindle 12 to web 18 and essentially concurrently severs the web from roll 11*a*.

While the roll 12*a* is running, the apparatus 10 may then be provided with a new roll of material on spindle 11, and splicing head 14 of splicing mechanism 23 may then be prepared with web from roll 11*a* to allow it to be spliced to web 18 when roll 12 a is depleted. In this alternating manner of running from one spindle while preparing the other spindle to provide a replenishing supply, the apparatus 10 can continuously provide a continuous running web 18 to a web consuming device.

Accumulator 13, while of a conventional general configuration, includes features to adapt it to controlling webs of materials that are prone to tearing, such as acetate film with thicknesses as thin as approximately 1 mil (0.001"), or less, and thin polyethylene films which are relatively extensible (elastic, stretchy). Such delicate film webs, can be even more difficult to handle, when they have a relatively narrow width, e.g., 2-4 in.", which are sometimes encountered when applying window patches to folding cartons. The combination of material characteristics, such as low tensile strength and high notch sensitivity, combined with minimal thickness and narrow web width combine to make web handling difficult and prone to interruptions from web breaks. A web consuming device such as a Tamarack® Vista® window applicator, which operates in a stop-and-go manner, further exaggerates the tendency to stretch or break a delicate web. The instant invention utilizes lightweight components such as thin-wall rollers 16 with low friction bearings, particularly at the lower, moving carriage 17 where the low mass of each roller reduces the vertical force and the rotational inertia. This makes the accumulator 13 more suitable for supplying a delicate web material.

In some cases thin-wall rollers 16 may be replaced with air bars which are stationary, but 'float' the web 18 by virtue of a supply of compressed air to the outer surface of the each bar. This compressed air is trapped to an extent by the web 18 as it wraps around the bars. 'Floating' the web 18 around each turn bar provides a very low friction conveyance of the web 18 through the accumulator assembly. In practice, however, air bars, of course, require energy-intensive compressed air, may be prone to clogging, and some web disturbances, such as a wrinkle may cause a momentary failure of the air flotation and a consequent moment of high drag and web breakage. Further, unused portions of air bars are typically wrapped or taped to conserve compressed air, and such masking and adhesive residue must be cleaned off when changing the set up to another web width. Web tracking control around multiple air bars can be problematic; even slight misalignments can cause large tracking errors.

The accumulator carriage 17 is free to move up, to supply web from the accumulator, or down to absorb web into the accumulator. The movement of carriage 17 is sensed and its position is used to control spindle brakes 11*b*, 12*b*, one on each of the unwind spindles 11, 12 to control the web tension and the delivery of web material to the accumulator 13. The carriage 17 has a low-friction guiding and support system, for example, a series of ball bearings engaging a vertical bar or shaft. The carriage is constructed of lightweight materials, such as aluminum, with component sizes minimized according to the loads they encounter, for a low-mass construction. This reduces web tension variation as the carriage moves up and down, potentially in response to rapidly changing web 18 motions, such as the aforementioned stop-and-go web consumption of a Tamarack Vista window applicator.

Figure 2:
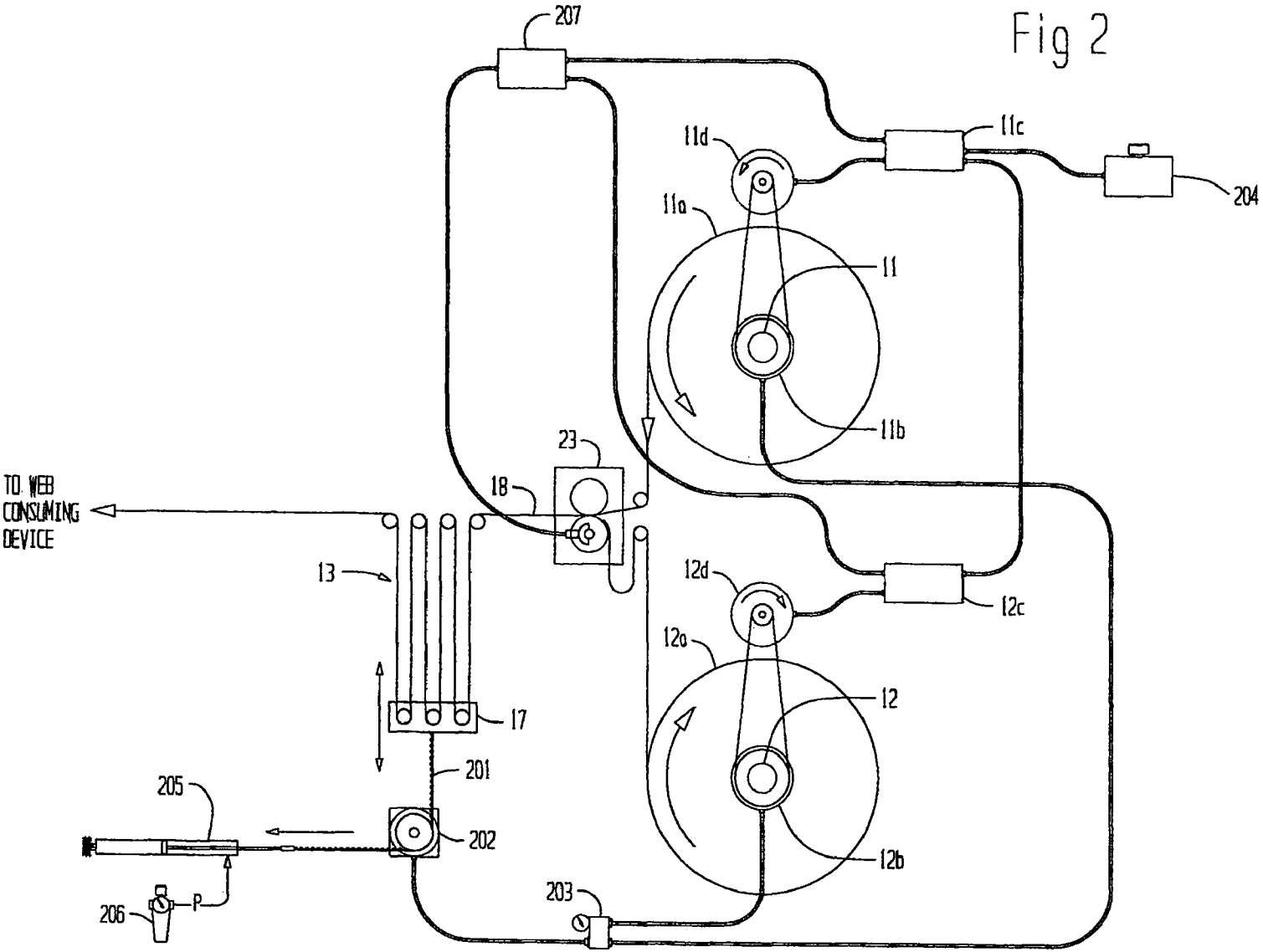
FIG. 2 is a simplified schematic illustration of a carriage and spindle drive control system for use with the continuous splicer apparatus of the present invention.

Referring now to FIG. 2, a schematic representation of the carriage and spindle drive control system, the accumulator carriage 17 is connected via a toothed belt 201 or lightweight chain, cable, or the like, to a Kinax® (GMC-I Messtechnik GmbH, Nuremberg, Germany) encoder 202. The Kinax encoder provides an electrical signal representative of the position of the carriage 17. At the bottom of the carriage's travel, a larger signal is produced, at the top of the carriage's travel, a smaller signal is produced.

The signal from the Kinax encoder is used as an input by a Proportion-Air® (McCordsville, Ind.) air pressure regulator 203. With a larger signal input signal, i.e., when the carriage is at the bottom of its travel, the regulator 203 sends approximately 50 psi to both brakes, 11*b*, 12*b*. The air pressure results in a braking force at each unwind spindle, 11, 12. This causes a reduction in the rate of web supplied to the accumulator 13, and an increase in web tension.

As the carriage 17 rises in response to the brake application or an increase in the rate of web consumption by the web consuming device, the signal from the encoder 202 reduces, thus reducing the pressure applied to both brakes 11*b*, 12*b*. When the system is adjusted properly, the carriage 17 will operate in the bottom ⅓ of the range of available travel, thus modulating the supply of web material to the web consuming device. With the carriage in the bottom ⅓ of travel, there is also sufficient storage of web 18 in the accumulator 13 to allow for a splicing event, during which there is some brief interruption to the supply of web from the unwinds 11 or 12. When the web consuming device operates in an intermittent, i.e., stop-and-go manner, the low-inertia carriage 17 is free to move up and down slightly, with minimal change in web tension, while isolating the intermittent feeding of web 18 out of the accumulator 13 from the relatively high inertia, relatively steady rotation of the supplying roll 11*a* or 12*a*.

The same pressure may be sent to both brakes 11*b*, 12*b*. This is satisfactory because only one of the spindles 11 or 12 is supplying web 18, while the other spindle is stationary, awaiting a splice event to splice a replenishing supply of web from its roll of web material. In other words, varying the braking on the stationary spindle has no effect on the system operation.

To assist in the goal of delivering web 18 with reduced web tension, each of the spindles 11, 12 is also equipped with a spindle drive 11*d*, 12*d*. A torque motor from Graham Motors and Controls™ of El Paso, Tex. is used for each of the drives 11*d*, 12*d*. A torque motor uses a DC voltage and current from a DC drive circuit 11*c*, 12*c* (such as provided by Fincor Automation, Inc. of York, Pa.) to provide a torque output. The torque output varies from a maximum at zero rpm and diminishes as rpm increases. The maximum torque of both torque motors 11*d*, 12*d* may be adjusted to the same amount via a potentiometer 204. The motor torque is used to accelerate the stationary roll of web material at a splicing event, and as the unwind spindle accelerates to a nominal running speed, the torque is reduced. The reduced torque at running speed results in little additional load for the brake to modulate, saving energy and reducing brake wear. The PLC 207 controller, acting according to an input from the splicing head 23 which will be described in more detail herebelow, activates or deactivates the drives 11*c*, 12*c* and motors 11*d*, 12*d* depending on which roll 11*a* or 12 *a* is supplying the web 18.

An air cylinder 205 may be used to provide additional tension in web 18, for example when wider or thicker webs are fed through the device. The tension may be adjusted via an air regulator 206 which adjusts the air pressure provided to the air cylinder.

When a splice is required to join a depleting roll of web material to a replenishing roll of web material, the opposing, essentially mirror-image splicing heads 14, 15 perform a splicing operation. While the splicing operation may range from a manual initiation, to a fully automated operation, a manual operation will be described.

Referring now to FIGS. 3*a*-*e*, which illustrate sequential steps in a typical splicing operation, splicing heads 14 and 15 are illustrated in schematic format, omitting conventional structural components such as frames, bearings, connecting and operating links, etc., to show the operation of the inventive splicing process and apparatus.

Figure 3A:
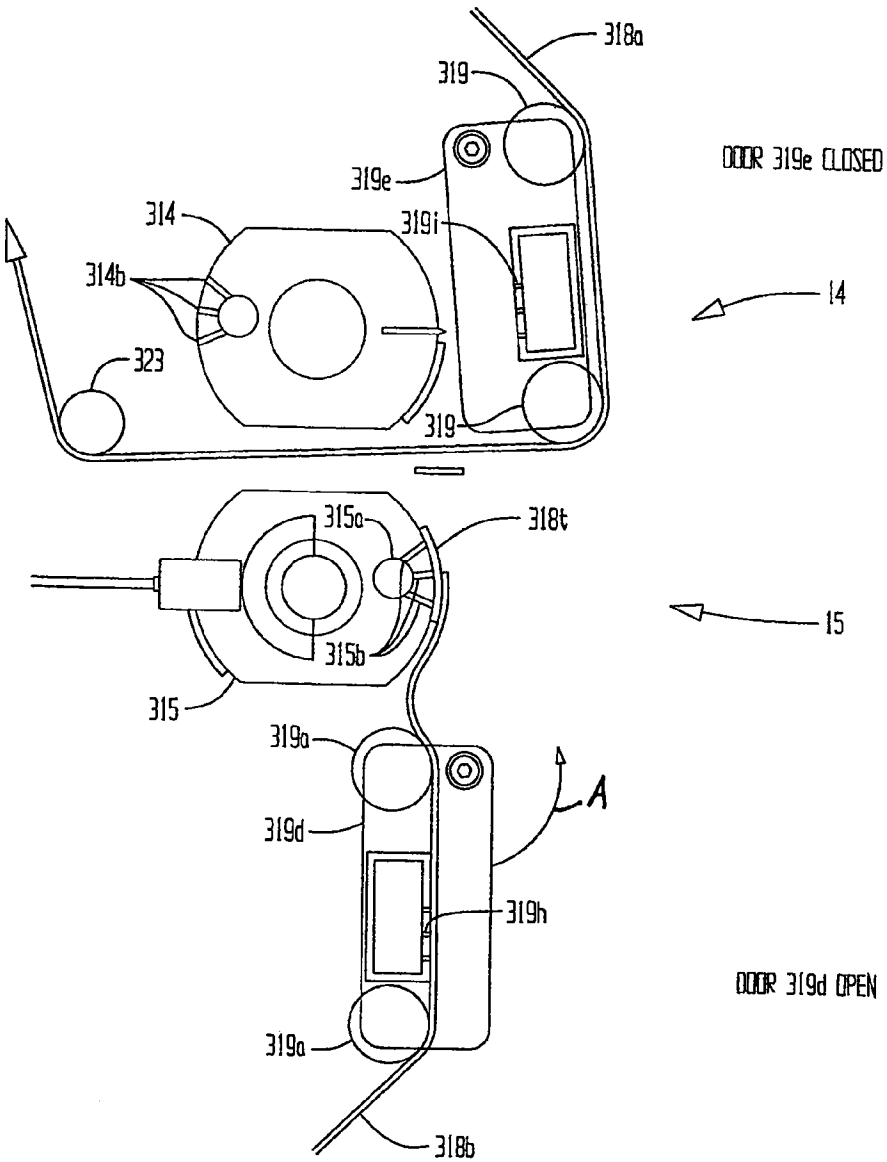
FIGS. 3*a*-3*e* illustrate the sequence of movements and operations in splicing a replenishing web to a depleting web carried out by the splicing cylinders and idler rollers of the continuous splicer apparatus of the present invention.

In FIG. 3*a*, depleting web 318*a* supplies web to the accumulator 13 of FIG. 1 and the web consuming machine. Web 318*a* is routed through the upper splicing head 14 via idler rollers 319, 323. Replenishing web 318*b* is in a stationary, standby condition, nearly ready to splice to the depleting web 318*a*. Splicing cylinders 314, 315 are also in a stationary, stand-by condition. An operator has manually prepared splicing station 15. Access to splicing cylinder 315 is provided by door 319*d*. In FIG. 3*a* the lower door 319*d* is shown in the open position. It may be closed, by swinging it upwards in the direction of the arrow A after preparing the replenishing web 318*b* for a splicing operation. In comparison door 319*e* of splicing head 14 is shown in the closed position. To prepare splicing cylinder 315 for the next splicing operation, the operator applies a piece of adhesive tape 318*t* to the vacuum-equipped portion of splicing cylinder 315. The vacuum (i.e. reduced pressure below atmospheric) is provided in a known method by a vacuum source (blower) 24 (FIG. 1). Vacuum hose (not shown) connects the source 24 to a vacuum manifold fitted to at least one end of splicing cylinder 315. The vacuum manifold provides vacuum to the gun-drilling 315*a* and vacuum holes 315*b* provide vacuum (suction) to the outer surface of the splicing cylinder 315. The vacuum holds the adhesive tape 318*t* to the circumference on the splicing cylinder adjacent the vacuum holes 315*b*. The vacuum equipped surface of cylinders 314, 315 may be provided with a neoprene surface with a nominal thickness of 0.030" thick. The neoprene provides several benefits:

It provides a visual cue to the operator for applying and locating the piece of tape 318*t;*

It helps to seal the vacuum when tape 318*t* covers the vacuum holes 314*b*, 315*b*; and It enhances the grip of the tape 318*t* on the cylinder 314 or 315.

The operator then pulls the leading end of the replenishing web 318*b* around idlers 319*a* and adheres the lead edge of replenishing web 318*b* to the trailing half of the adhesive of the adhesive tape 318*t* (as illustrated). A vacuum plate 319*h* holds the web 318*b* so that when the operator closes the access door 319*d*, a loop 318*c* is formed from the replenishing web 318*b* approximately as shown. The loop 318*c* (FIG. 3*b*) provides an amount of slack web that will facilitate the splicing process, but otherwise the size of loop 318*c* is not especially critical. Vacuum may be supplied to the plate 319*h* from the vacuum blower 24 (FIG. 1) via hose or piping (not shown). In the instant invention, a rotary union may be used at the door 319*d* pivot for a more compact and dependable solution than a hose which flexes and wears each time the door 319*d* is opened and closed.

Figure 3B:
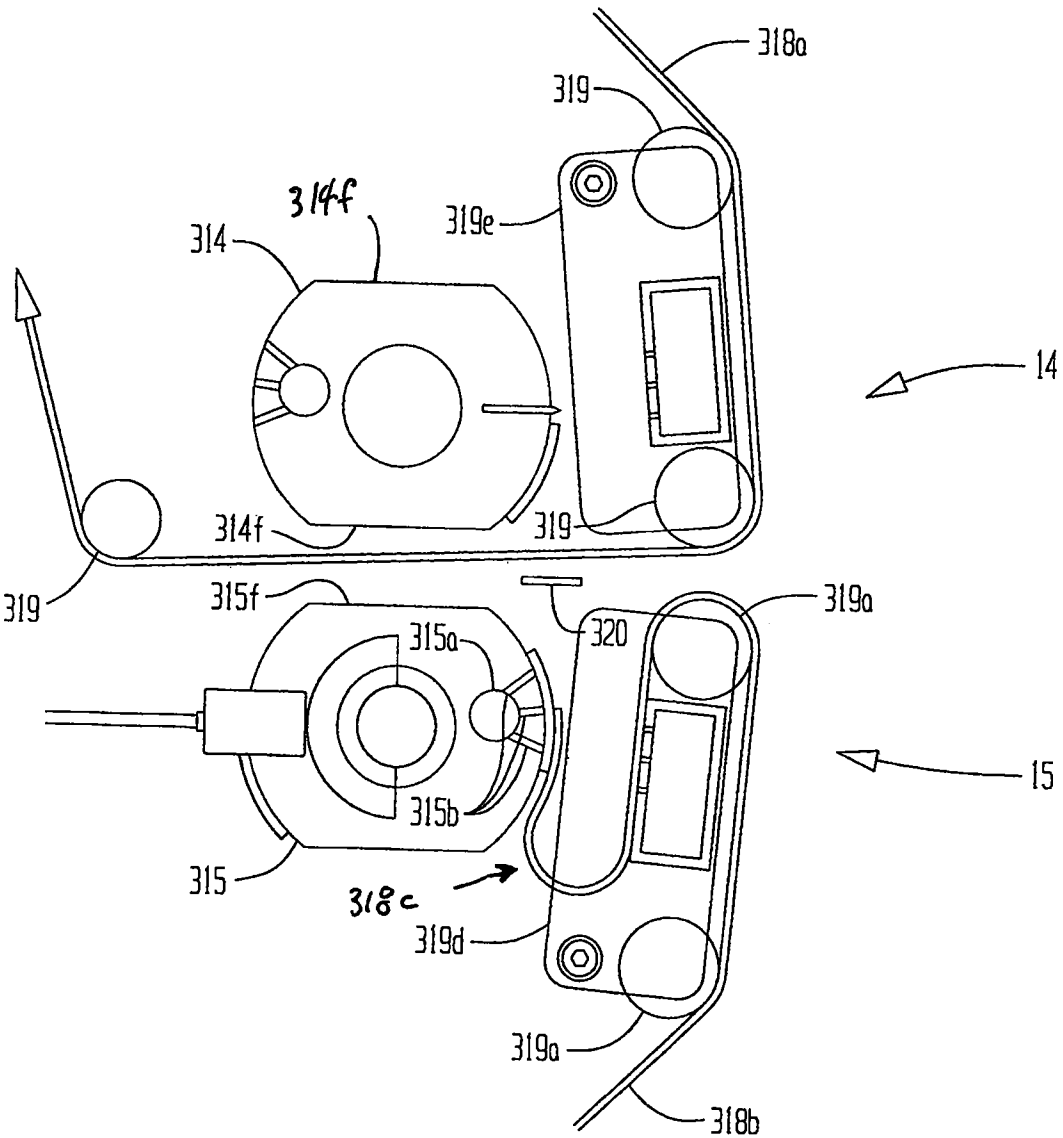

FIG. 3*b* shows the apparatus in a standby condition, with access door 319*d* closed, where the apparatus is ready to splice web 318*b* to depleting web 318*a*. Cylinder 314 is provided with opposing flats 314*f*, 315*f* which provide clearance for the web 318*a*, in case its delivery should become unsteady and a 'flutter' or waving of web 318*a* occur. Further, the flats (on both cylinders 314 and 315) advantageously reduce the polar moment of inertia of splicing cylinders 314, 315. Anvil strip 320 is in a stationary, standby position, as shown. An anvil strip 320 is driven in conjunction with the rotation of cylinders 314, 315 as shall be further disclosed herebelow.

Figure 3C:
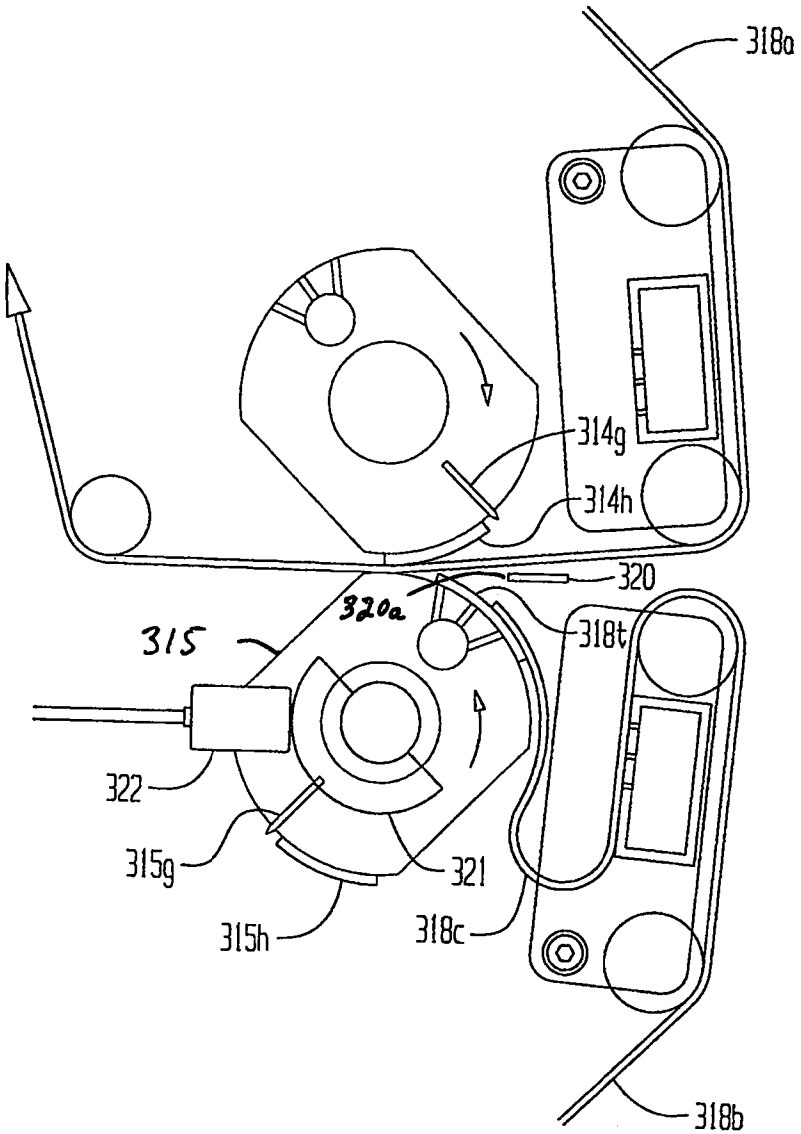

Referring next to FIG. 3*c*, a splicing operation has been activated. The activation could occur in a variety of ways, for example:

1. In a fully automated process, where a sensor (not shown) has sensed that the supplying roll 11*a* (FIG. 1) is nearly depleted and thus signal and initiate a powered rotation of splicing cylinders 314, 315, 2. In a semi-automated process, where the operator has determined that supplying roll 11*a* is nearly depleted and pressed a button, or otherwise actuated the system to initiate a powered rotation of the splicing cylinders 314,315, or, 3. In a manual process, where the operator has been signaled or observes that the supplying roll 11*a* is nearly depleted and initiates a rotation of the splicing cylinders 314, 315 via a crank handle or the like. The manual process illustrates the simplicity of the inventive splicing method because it demonstrates that no particular operator technique, timing, or speed coordination are required for a flying splice. This also suggests that other known methods of driving and automating the splicing operation may be readily applied.

Regardless of the method of rotating the splicing cylinders 314, 315, splicing cylinder 314 counter-rotates relative to splicing cylinder 315 via 1:1 gearing that couples the cylinders, as will be disclosed in more detail herebelow. The directions of rotation of cylinders 314 and 315 are indicated by arrows in FIGS. 3*c*-3*d* as is the web direction 318*a* or *b*. Of course, alternative web directions could be accommodated by revising the cylinder rotations accordingly. As cylinders 314, 315 rotate, anvil 320 moves from its initial position as shown in FIGS. 3*a* and 3*b* towards a position in between splicing cylinders 314, 315 to provide a cutting anvil surface for blade

Figure 3D:
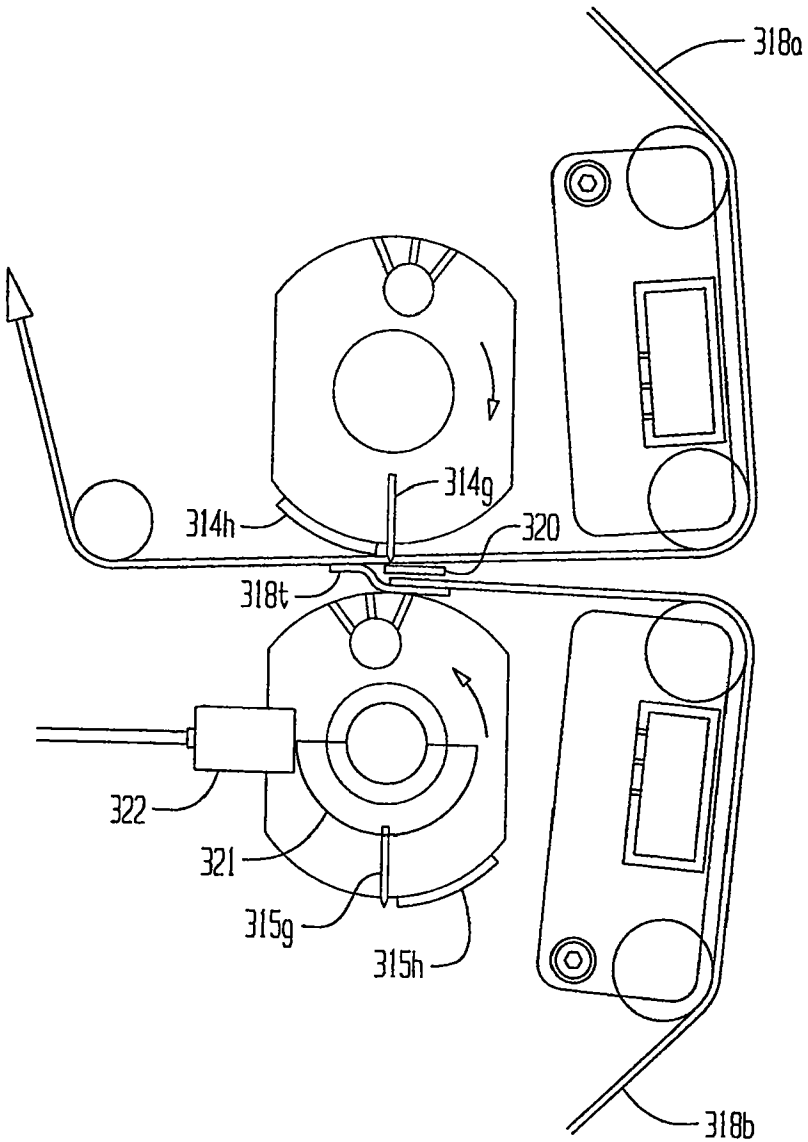
Figure 3E:
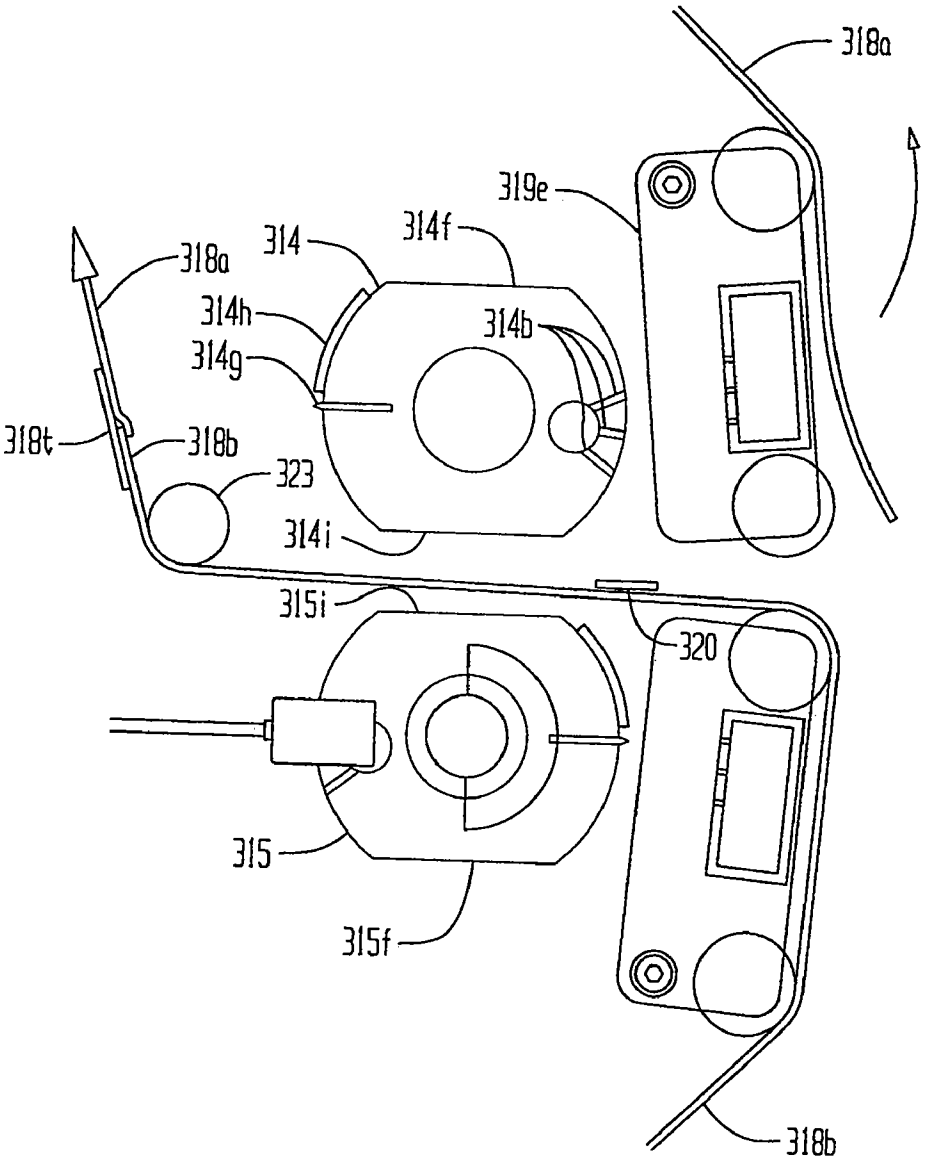

314*g* as shown in progressive stages in FIGS. 3*c* and 3*d*. In FIG. 3*e*, anvil 320 has retracted to its initial or standby position.

Splicing cylinder 314 is equipped with a cutting blade 314*g* and a pad 314*h*. Splicing cylinder 315 is equipped with a counterpart blade 315*g* and pad 315*h*. The blades are cutting rule as provided by Helmold of Elk Grove Village, Ill. The pads are nominally ⅛" thick Poron foam with a pressure-sensitive adhesive backing as provided by McMaster-Carr Supply Company of Elmhurst, Ill. In FIG. 3*c*, the pad 314*h* has rotated with cylinders 314 and 315 such that it is now contacting web 318*a* and pressing web 318*a* into contact with the surface of cylinder 315. This contact has the effect of engaging the moving web 318*a* with the moving cylinder 315, in the case of the manually operated system, this has the beneficial result of approximately, and automatically, matching the speed of the web 318*a* and the splicing cylinder 315 surface. The function of pad 314H could alternatively be provided by other forms of protuberance such as a metallic or plastic leaf spring, or a blast of compressed air provided via drillings in cylinder 314 and air manifold as known in the art. It is advantageous for splicing cylinders 314, 315 to have a reasonably low rotational inertia, although the instant apparatus splices delicate webs as narrow as 2" at production speeds with steel splicing cylinders approximately 15 in. wide and 4 in. in diameter.

Again referring to FIG. 3*c*, anvil 320 has advanced towards the nip between the cylinders 314, 315, driven via a crank/connecting rod linkage, which is disclosed in more detail below. As seen in FIG. 3*c*, the lead edge of adhesive tape 318*t* is about to contact the bottom surface of web 318*a*. The loop 318*c* of web material 318*b* has diminished to some extent, as the stationary web 318*b* approaches the speed of the depleting web 318*a*.

A lobe 321 of cylinder 315 interacts with a proximity switch 322 which activates one of spindle drive torque motors 11*d* or 12*d* (FIGS. 1, 2) to a preset torque. In FIG. 3*c*, the proximity of lobe 321 to proximity switch 322 will cause proximity switch to assume an 'on' or 'high' condition, which via a PLC (programmable logic controller) 207 (FIG. 2) such as provided by Omron Manufacturing of America, St. Charles, Ill., activates the drive 11*c* to power torque motor 11*d* to a preset torque which tends to drive the web 318*a* as modulated by pneumatic brake 11*b* as described previously.

FIG. 3*d* shows the splicing mechanism after further rotation, at some point after tape 318*t* has adhered to the bottom surface of web 318*a* and effectively joined the lead edge of web 318*b* to web 318*a* and just as blade 321 has engaged web 318*a*. The loop 318*c* has been taken up as the replenishing web 318*b* accelerates to the speed of the depleting web 318*a*.

Lobe 321 is leaving proximity with proximity switch 322 causing a change in state of switch 322 from an 'on' or 'high' condition to an 'off' or 'low' condition. The change of state causes PLC 207 (of FIG. 2) to switch off drive 11*c* and torque motor 11*d* and switch on drive 12*c* and torque motor 12*d*. These actions tend to decelerate roll 11*a* and accelerate roll 12*a* at essentially the same time as blade 314*g* and anvil 320 cooperate to sever web 318*a*.

Blade 314*g* is adjusted to a height sufficient to sever web 318*a* against anvil 320, while web 318*b* travels below anvil 320 and so replenishing web 318*b* is not severed. The anvil 320 is supported during the severing action by the underlying web 318*b* and the surface of splicing cylinder 315, and the anvil 320 is interposed between blade 314*g* and the replenishing web 318*b* to protect the replenishing web 318*b* from being cut.

FIG. 3*e* shows a further rotation of splicing cylinders 314 and 315. Flats 314*i*, 315*i* are now adjacent and parallel the general path of web 318*b* between splicing cylinders 314, 315 as it travels to the accumulator 13 (of FIG. 1). Anvil 320 is withdrawn to its inactive or rest position. The spliced portion, where tape 318*t* and replenishing web 318*b* are joined with depleting web 318*a*, is illustrated downstream of roller 323. A slight overlap of the webs 318*a*, 318*b* as shown is desirable, so that the aggressive adhesive of tape 318*t* is completely covered to prevent it from adhering to a roller or turn bar or the like as it travels to the web-consuming device. The presence of an overlap or a gap is largely a matter of the positioning of the lead edge of web 318*b* as it is placed onto the tape 318*t* in the set-up step of FIG. 3*a*. Scribe marks on the surface of cylinders 314, 315 or other visual aids to the operator assist in assuring the desired overlap condition. The anvil 320 has retracted to its initial position as in FIG. 3*a, b*. Roll 11*a* will ideally have stopped rotating to avoid feeding out excessive amounts of web 318*a*. It should be noted that the exact stopping instant of roll 11*a* is not critical to the satisfactory function of the splicer. The operator may now remove depleted roll 11*a* of FIG. 1 and replace it with a full roll on spindle 11. Vacuum holes 314*b* are now positioned so that when the operator opens the door 319*e* in the direction of the arrow, thus moving idler rollers 319 out of the way, the operator may prepare another piece of tape, setting it over the vacuum holes 314*b*. The lead end of the web 318*a*, from the replaced, full roll 11*a* (FIG. 1) may be attached to the tape, again providing a loop of web material 318 *a*, similar to the counterpart, loop 318*c*, previously prepared in web 318*b*. This prepares the splicer for the next splice, i.e., when web 318*b* later becomes depleted and another splice cycle may be initiated using the mirror-image counterparts of the components described in FIGS. 3*b, c, d* and as described above.

In a manually controlled splicer, detents may be provided to assist the operator in positioning the splicer in either of the standby positions, as shown in FIGS. 3*a, b*, and *e*. It is particularly desirable that the operator not over-rotate the splicing mechanism because if the splicing cylinders 314, 315 are rotated too far before beginning a splice, one of the blades 314*g* or 315*g* may unintentionally sever the supplying web before another splice is prepared, resulting in the need to stop the web consuming machine and re-web the splicer and web consuming machine, a time-consuming process. In an automatic or semi-automatic splicer, a conventional servo drive or equivalent may be readily programmed to position the rotors in the standby positions 3*a, b* and 3*e*. Such a servo drive, e.g., Indradrive provided Bosch Rexroth with US headquarters in Hoffman Estates, Ill. may also be programmed to rotate the splicing cylinders at appropriate speeds to match, approximately or precisely, the speed of the active, i.e., depleting web, allowing rapid splices at high web speeds with minimal variation in web tension. The servo drives can also readily be programmed to include interlocks so that servos will not rotate splicing cylinders 314, 315 and will not move anvil 320 unless the doors 319*d*, 319*e* are closed, said doors also including guards to prevent human access into the splicing cylinders' 314, 315 in-running nip.

Idler roller 323 may be equipped with a speed and direction of rotation sensor which may interact with PLC 207 and drives 11*c*, 12*c* to monitor feeding of the web (either 318*a* or 318*b*). For example, if idler 323 is not rotating when either of drives 11*c* or 12*c* are activated, this is an indication that the web is not flowing properly through the apparatus and drives 11*c* and 12*c* should be turned off to prevent uncontrolled unwinding of roll 11*a* or 12*a*. Similarly, if idler 323 rotates backwards, this would be an indication of a "wrap-up" of web in some part of the splicing apparatus and again drives 11*c* and 12*c* should be turned off and an alarm may be sounded and/or lit.

In case of a splicing event while the supplying web is stopped, and simultaneously carriage 17 (FIGS. 1, 2) is near the bottom of its travel and thus activating the brakes 11*b*, 12*b*, it would be beneficial to release the brakes 11*b*, 12*b* momentarily to allow the supplying web to move as it is gripped by splicing cylinders 314,315 as in FIGS. 3*c*,3*d*. The speed sensor associated with idler 323 would supply a zero speed signal to PLC 207 (FIG. 2) which would be programmed to process this zero speed signal and the near-bottom position signal of carriage 17 (via encoder 202) and then deliver a command to release the brakes 11*b*, 12*b* during the splicing operation. The splicing operation could be signaled to the PLC 207 in a variety of ways:

The operator could press a button during a splice.

Figure 4A:
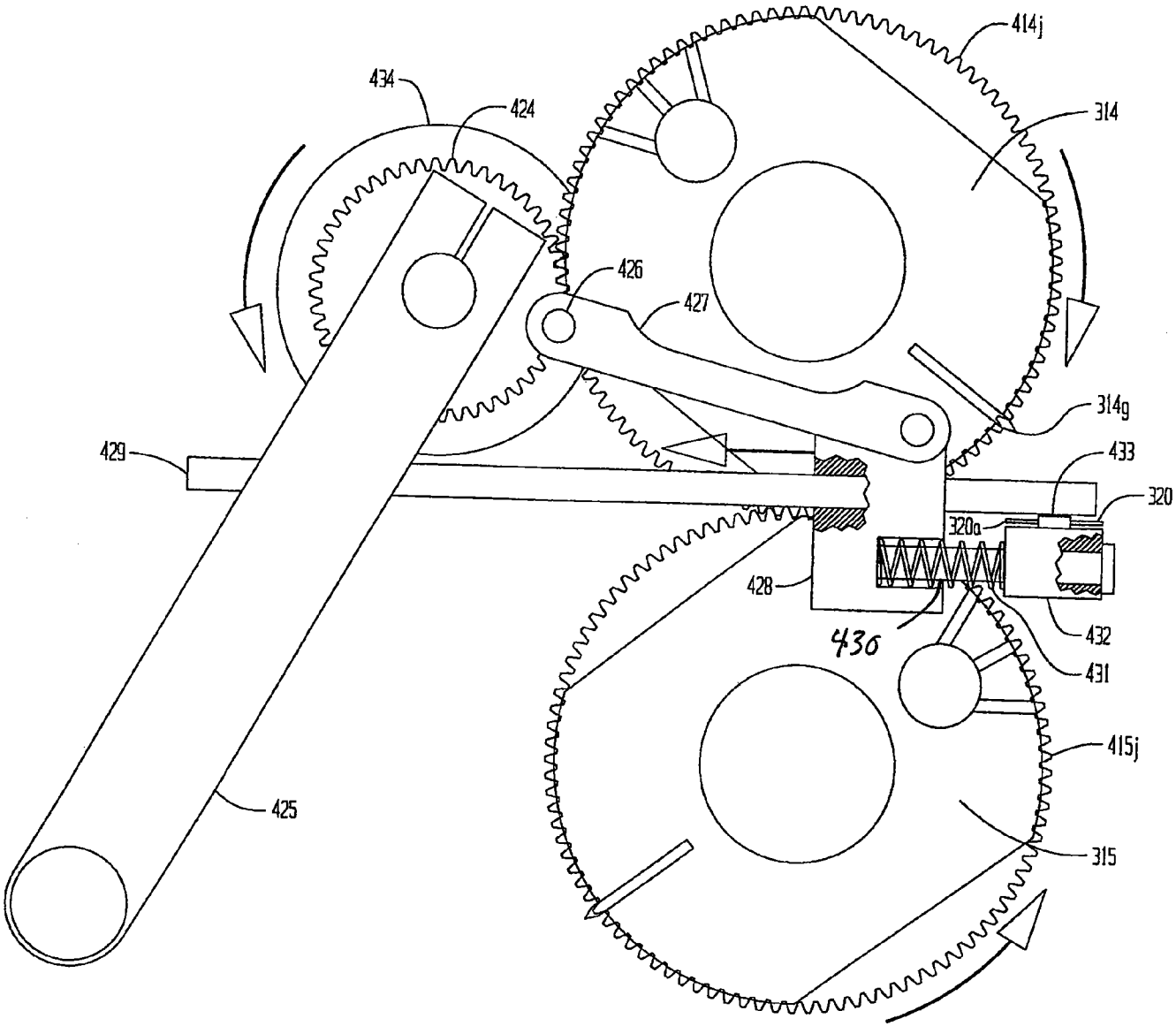
FIGS. 4*a* and 4*b* are respectively simplified schematic end and front views of a splicing assembly for use in the continuous splicer apparatus of the present invention.

A sensor could be mounted to read the motion of gear teeth 424, 414*j*, or 415*j* as shown in FIG. 4*a*.

A proximity switch could be mounted near the periphery of one of the cylinders 314, 315—in running position (no splice) the switch would be positioned to sense the position of any of the flats 314 *f, i* or 315 *f, i* and to signal a splice, the proximity switch 322 would become active when the non-flat periphery of splicing cylinders 314, 315 approaches the proximity switch.

An encoder could be installed on the rotational axis of either splice cylinder or drive gear 424 to provide speed and/or position data to the PLC 207.

A simpler alternative to accommodating a splice while the web 318 is stopped is to build-in some compliance or over-travel to a portion of the web guiding idler roller upstream (preceding) the splicing head 23, such as in the doors 319*d, e*. The doors 319*d, e* could allow some over travel under a greater than operating load, to allow the doors to deflect as needed to allow the stationary depleting web to move as required when it is engaged by one of the pads 314*h*, 315*h* and the opposing cylinder 315,314, respectively, then when the splice is completed, the doors 319*d,e* would be free to spring back into their normal closed position.

Figure 4B:
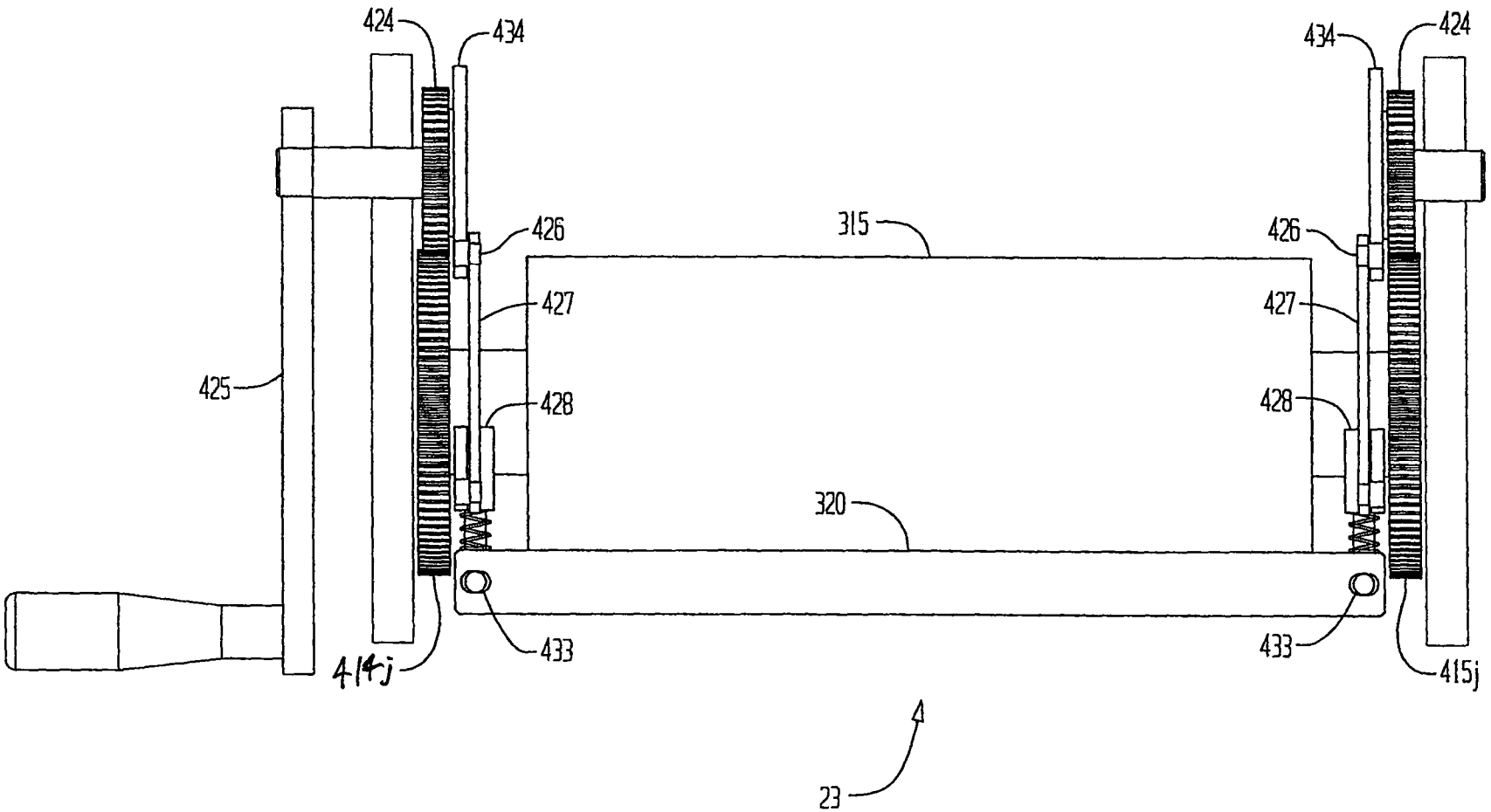

FIG. 4*a* is a schematic end view of the splicing assembly 23 of FIG. without conventional frames, bearings, etc., that support and allow rotation of cylinders, etc. FIG. 4 *b* is a simplified schematic side view of a portion of splicing assembly 23. FIG. 4*b* also deletes conventional frames, bearings, guides, etc., that locate and support the various components of the invention. FIGS. 4*a, b* illustrate the mechanism coordinating the rotation of splicing cylinders 314 and 315 as well as the motion of anvil 320. Each of cylinders 314, 315 is equipped with a timing gear 414*j* and 415*j* respectively. In FIG. 4*b*, gears 414*j*, 415*j* are shown towards respective ends of the splicing cylinder 315. These gears provide symmetrical driving for both ends of the anvil strip 320, as the length of the anvil strip 320 typically precludes the use of a cantilvered or centered drive. Gears 414*j* and 415*j* could advantageously have a circular pitch so the pitchline of the gear coincides with the effective diameter of the splicing cylinder. This allows the gears to act directly on each other and eliminates the need for idler gears. In the illustrated embodiment, the splicing cylinders 314, 315 are the same diameter and so the gear ratio between gears 414*j* and 415*j* is 1:1. Other (non-matching) diameters and ratios could be employed as well. In the instant invention, drive gear 424 is activated by a human operator via a crank handle 425. Drive gear 424 (FIG. 4*a*) includes a hub 434 with crankpin 426. Crank pin 426 drives a connecting rod 427 which drives anvil strip 320 via a slide block 428 which is guided by a guide rod 429. Slide block 428 includes a secondary guide bar 430, a cushion spring 431 and an anvil slide block 432. Anvil slide block 432 includes a mounting pin 433 to anchor on the near side of the anvil 320 on the anvil slide block 432. Drive gear 424 has half the number of teeth as drive gear 414*j* because the anvil strip is to cycle twice for every revolution of the splicing cylinders, i.e., there are two splicing cycles for one revolution of handle 425 in the illustrated embodiment.

The timing of the positioning of the anvil strip 320 relative to position of the cutting blade 314*g* is preferrably adjusted so that the anvil strip leading edge 320*a* clears the foam pad 314*h* (see FIGS. 3*c*, d) and also the insertion speed of the anvil strip approximately matches the speed of the tip of blade 314*g*, 315*g* during a web severing event. The timing may be adjusted by known means of shifting the phase of gear 424 on a hub 434. The hub 434 includes the crankpin 426. For the geometry of FIG. 4, when the crankpin 426 is at the 12 o'clock position, the lead edge 320*a* of the anvil 320 will be slightly past the blade 314*g* and the speed of the anvil 320 will match the peripheral speed of the tip of blade 314*g*.

FIG. 4 is schematic in nature, therefore the instant invention, which may have splicing cylinders 314, 315 and anvil strip 320 approximately 14½ inches wide, has components 428, 429, 430, 431, 432 and 433 at each end of the anvil strip, to properly support it, even though only one end is shown.

Several alternative embodiments are envisioned with the goal of reducing or even eliminating the need for a vacuum system; a vacuum system increases the initial cost of the apparatus and the operating costs.

In an embodiment which eliminates the need for vacuum at the splicing cylinders 314, 315, a splicing tape with adhesive on both sides could be substituted for the one-side adhesive tape 318*t* of FIG. 3*a*. The adhesive on a first side would hold the tape 318*t* to the splicing cylinder 315, the adhesive on the second side would adhere the tape to the lead end of replenishing web 318*b*. Preferably, the adhesive tape would have a relatively weaker adhesion to the surface of the splicing cylinder 315, so that it would not interfere with the eventual transfer from the splicing cylinder 315, during the splicing operation, to the depleting web 318*a*. This would eliminate the need for vacuum provisions in the splicing cylinders 314, 315 and the attending costs of vacuum drilling 315*a* and vacuum holes 315*b* (and their counterparts in cylinder 314), the vacuum manifold, not shown, and attending hoses and piping. The need for vacuum at the vacuum plates 319*h*, 319*i* in doors 319*d*, 319*e* could be supplied by a smaller vacuum blower 24. Or, the blower 24 could be eliminated entirely by using conventional pneumatic clamps instead of the vacuum plates 319*h*, 319*i*. Such clamps would be released during the splicing sequence via the controller and solenoid valves.

Figure 5A:
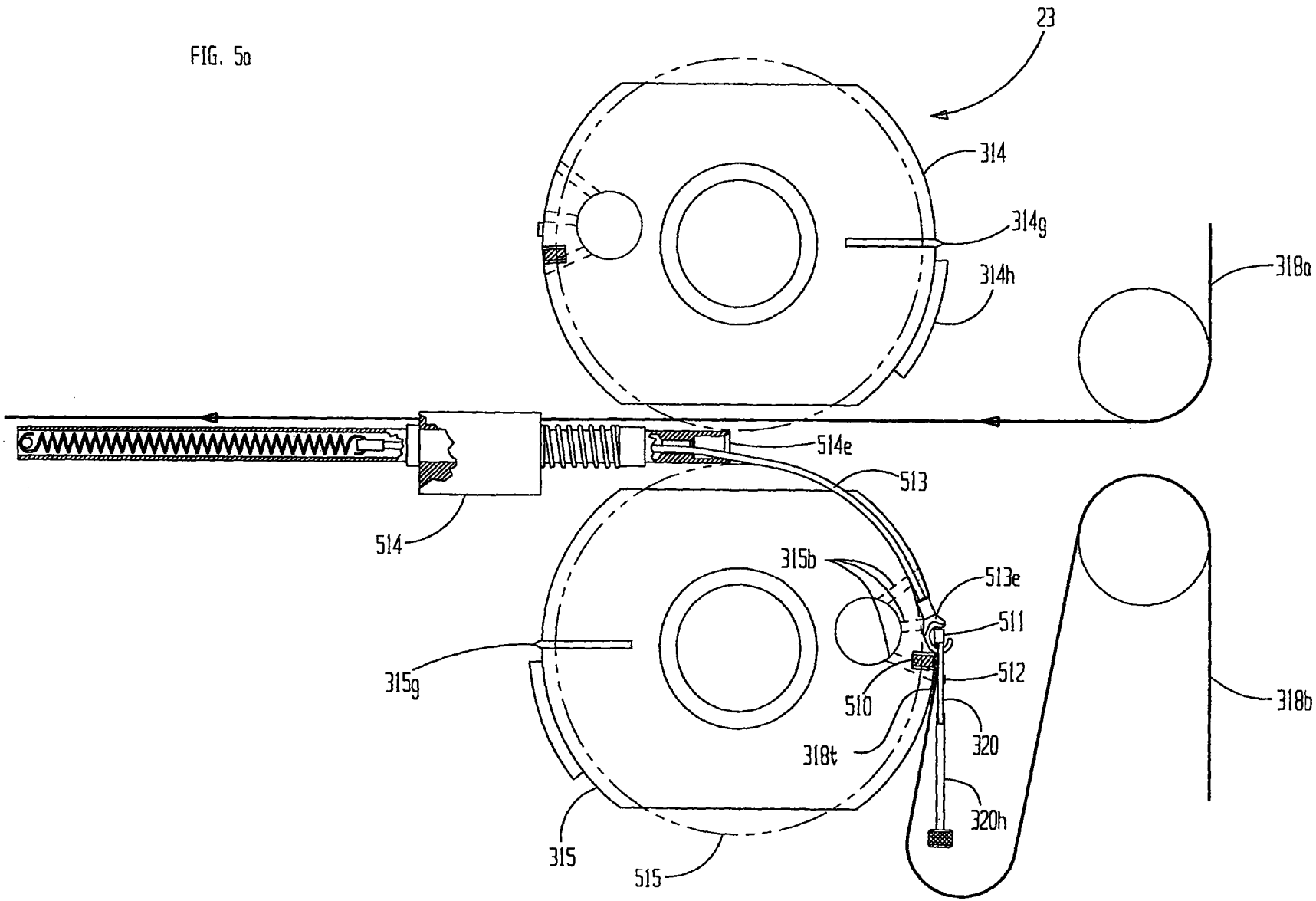
FIGS. 5*a*-5*e* are end views of an alternative embodiment of a splicing assembly for use in the continuous splicer apparatus of the present invention.
Figure 5B:
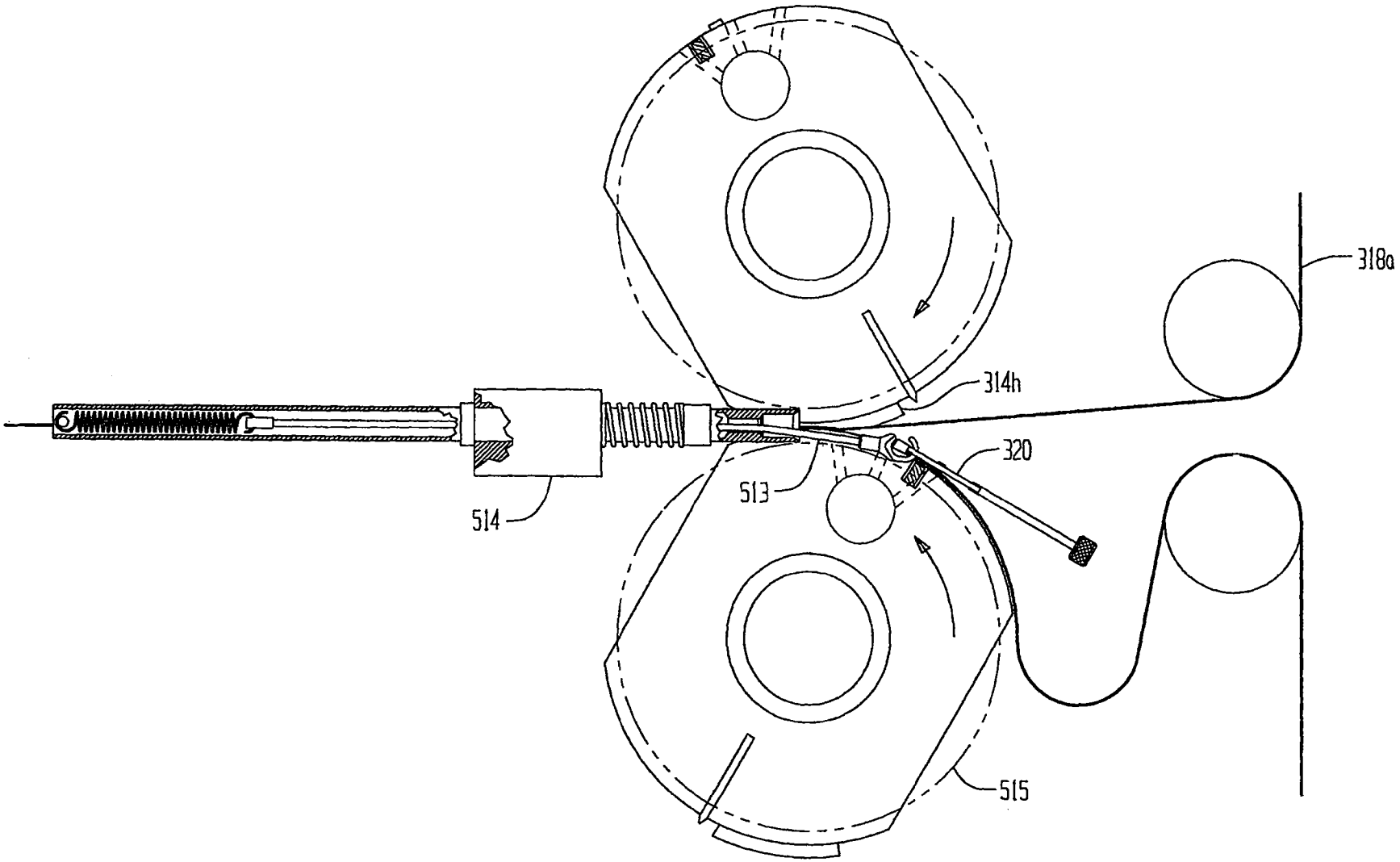
Figure 5C:
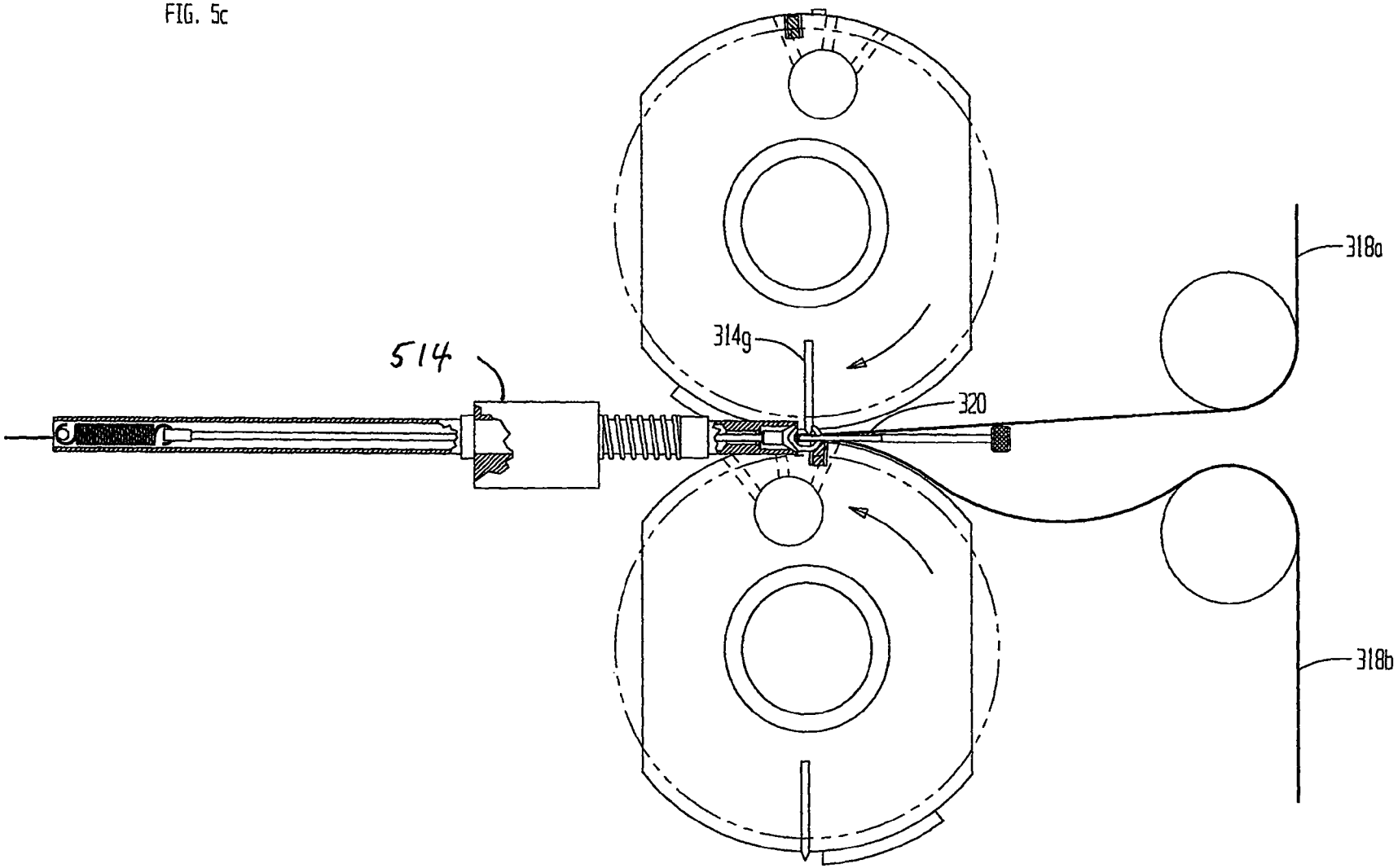
Figure 5D:
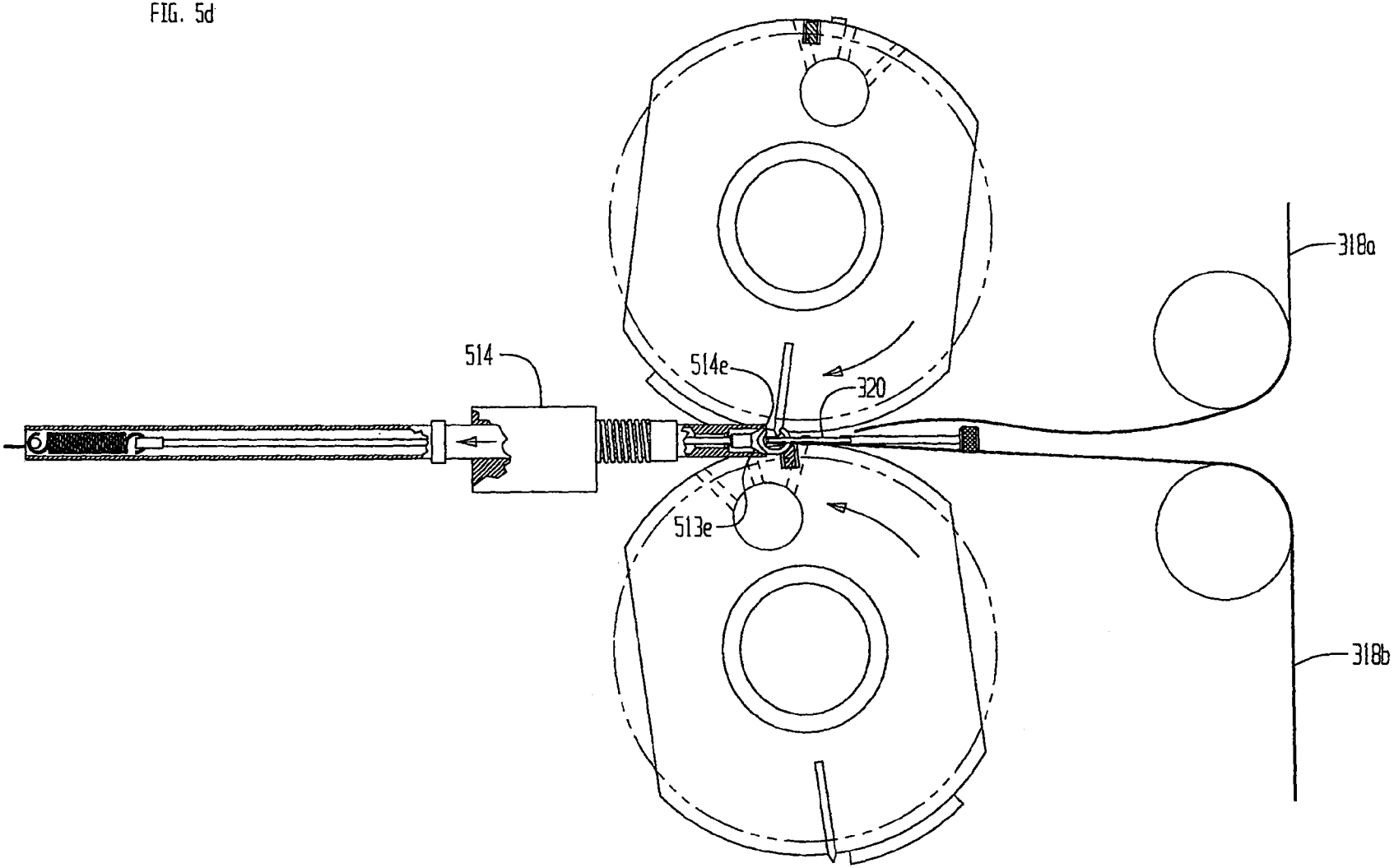
Figure 5E:
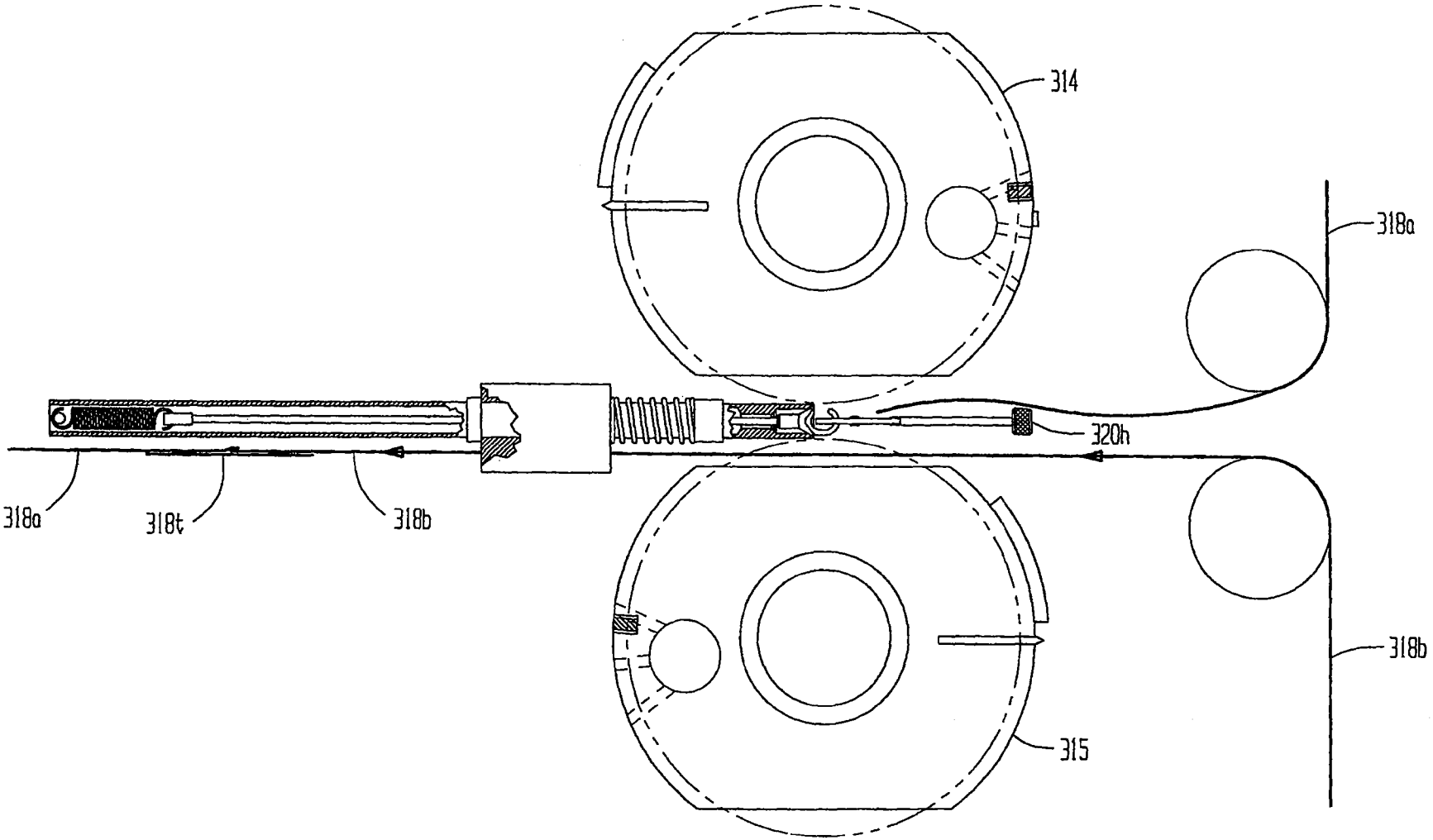
Figure 6:
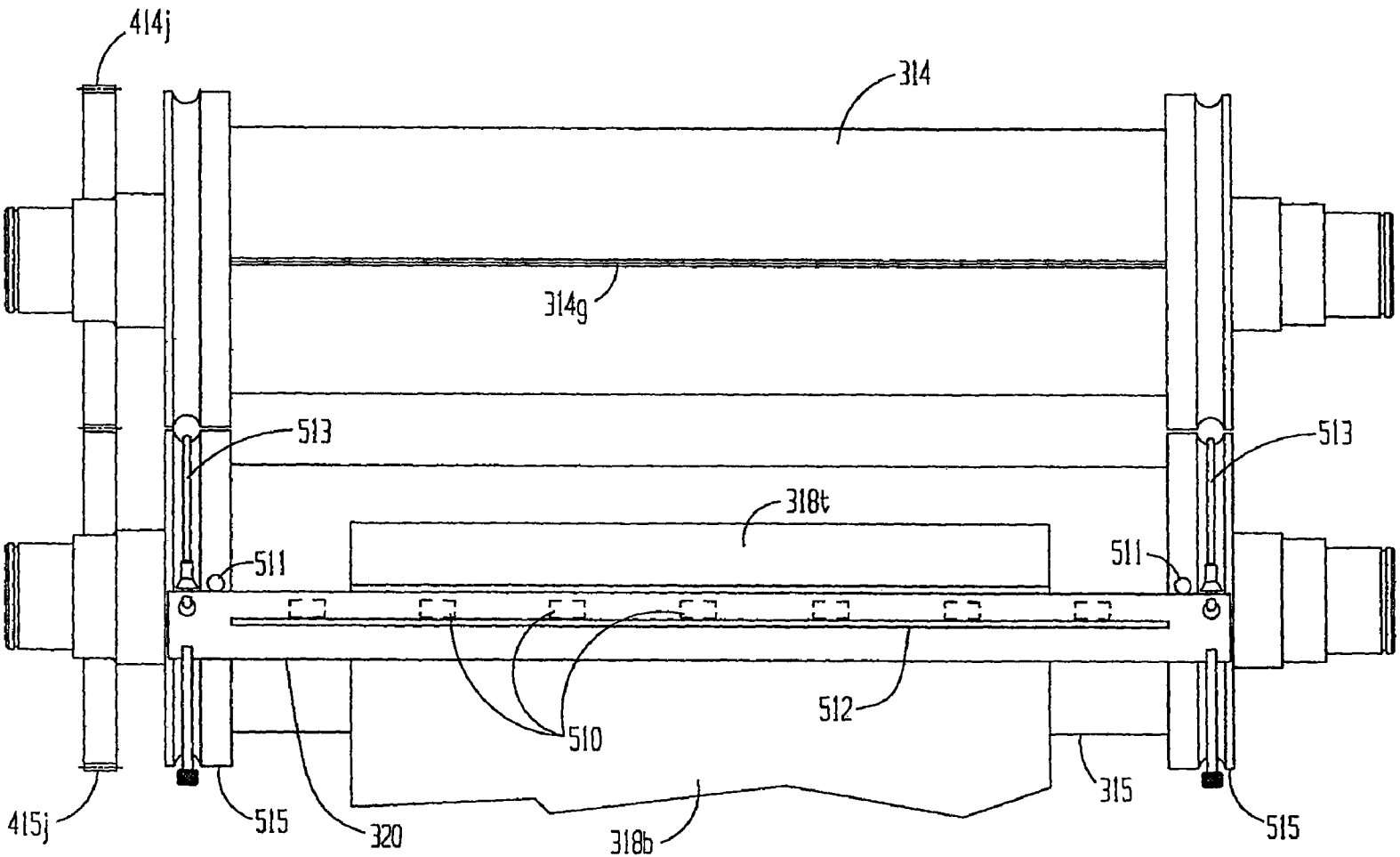
FIG. 6 is a front view of the splicing assembly shown in FIGS. 5*a*-5*e*.

FIGS. 5*a-e* and 6 illustrate an alternative embodiment of splicing head 23 and method for holding the lead end of a replenishing web 318*b* and providing a simplified mounting and driving of anvil strip 320. Splicing cylinder 315 is equipped with magnets 510 (one illustrated in schematic end view FIG. 5*a-e*, see FIG. 6 for side view) and lugs 511 (again only one shown in schematic FIG. 5*a-e*, but spaced along the length of the cylinder, see FIG. 6 for side view). The operator places tape 318*t* on the surface of the cylinder 315. The operator then places the lead edge of replenishing web 318*b* on trailing half of tape 318*t* on cylinder 315. In FIG. 6 the lead portion of tape 318*t* is shown; the trailing portion of tape 318*t* lags behind and is adhered to web 318*b*. Next, the operator places anvil strip 320 over the lead end of web 318*b*, abutted against end lugs (one shown but spaced across the axial length of the cylinder) 511. The anvil strip 320 is preferrably made of a ferrous steel alloy, so the magnets 510 hold the anvil strip 320 in place on the splicing cylinder 315 and, in turn, the lead end of web 318*b* is clamped in place between anvil strip 320 and surface of cylinder 315. A raised resilient strip 512 may be placed on both sides of the anvil strip 320; the raised strip on the left side of anvil strip 320 assures the flat anvil strip 320 has its lead edge firmly clamping tape 318*t* and web 318*b* against the splicing cylinder 315 surface, as shown, to cooperate properly with blade 314*g* during the cutting operation of supplying web 318*a*. The resilient strip 512 protrudes from both sides of anvil strip 320 so that its lead edge may be tipped into contact with either of the splicing cylinders 314 (when supplying web is 318*b*) and 315 (when supplying web is 318*a*) as required. Vacuum may be provided, as described previously, to vacuum holes (315*b* for cylinder 315) to hold the leading portion of tape 318*t* on the surface of splicing cylinder 315, as opposed to having tape 318*t* curl upwards or flap loose during rotation. Vacuum may be provided continuously, or intermittently, i.e., during a splicing operation, to save energy by running a vacuum source only when needed. Lanyards 513 hook onto anvil 320 via a hole at each end of the anvil strip and hooks 513*e*. Lanyard 513 is tensioned via a retractor assembly 514. When a splice is initiated, the cylinders 314 and 315 rotate in cooperation as described previously (FIGS. 3*b*-*e*).

Referring to FIG. 5*b*, a splice has been initiated and pad 314*h* presses the adhesive-equipped tape onto web 318*a*. Anvil strip 320 rotates along with cylinder 315, while the retractor 514 pulls in lanyard cable 513 to prevent slack in lanyard 513. End caps 515 (FIG. 6) may be equipped with grooves to locate and guide the lanyards 513.

In FIG. 5*c*, further rotation of splicing cylinders 314 and 315 has occurred. Blade 314*g* severs the depleting web 318*a* against the anvil 320. As in previous embodiments, anvil 320 overrides and prevents the replenishing web 318*b* from being cut, i.e., web 318*a* is on the upper surface of anvil 320 and web 318*b* is beneath anvil strip 320. Retractor assemblies 514 retract some of lanyards 513 and prevent slack from developing in lanyards 513.

In FIG. 5*d*, web 318*b* is now the supplying web (and will become the depleting web) and web 318*a* is severed and slack. Anvil 320 is now retained by the lanyards 513 and the lanyard hook 513*e* is bottomed in the end 514*e* of the retractor assemblies 514.

In FIG. 5*e*, the spliced portion of the web has proceeded past the splicing cylinders 314, 315, as seen in the drawing, the splicing tape 318*t* joins the severed end of depleting web 318*a* to the lead end of the replenishing web 318*b*. The retractor assemblies 514 and lanyards 513 have pulled anvil 320 to a retracted position and clear of the splicing cylinders 314, 315, with the flats on the splicing cylinders providing additional clearance for the web and the anvil strip 320. Handles 320*h* provide a convenient way for an operator to pull the anvil strip 320 out, so it is accessible for setting up the next splice, this time with a piece of tape on the upper splicing cylinder 314, so that web 319*a* may be prepared for the next splice. Splicing cylinder 314 is equipped with magnets, lugs etc. as described above for splicing cylinder 315. In this way, continuous supply of web to a web consuming device is possible by alternately reloading spindles 11, 12 (FIG. 1) and splicing cylinders 314, 315.

As in FIGS. 3*a*-*e*, the mirror-image arrangement of splicing apparatus 23 in FIG. 5 has splicing cylinders 314, 315 both equipped with blades, pads, etc. to allow the splicing operation to be initiated from the lower cylinder 315 and lower spindle 12 (FIGS. 1, 2) as described above, then be initiated from the upper cylinder 314 and upper spindle 11 and so on.

Having thus disclosed in detail plural embodiments of the invention, persons skilled in the art will be able to modify the structure illustrated and substitute equivalent elements for those disclosed; and it is, therefore, intended that all such substitutions and equivalents be covered as they are embraced within the scope of the appended claims.

The invention claimed is:

1. A continuous splicer apparatus for attaching a lead end of a replenishing web to a depleting web while the replenishing web and the depleting web are in motion, said splicer apparatus comprising:

first and second cylinders disposed in laterally spaced relation from one another and having respective first and second central longitudinal axes aligned in parallel with one another, wherein each of said cylinders is adapted for rotational displacement about its respective central axis;

first and second cutting elements disposed on respective first peripheral portions of said first and second cylinders, wherein each first peripheral portion of said cylinders is disposed in closely spaced relation to the other cylinder during a portion of rotation of said cylinders;

first and second tape retaining arrangements disposed on respective second peripheral portions of said first and second cylinders, wherein said second tape retaining arrangement is adapted to engage the replenishing web, and wherein each second peripheral portion of said first and second cylinders is disposed in closely spaced relation to a first peripheral portion of the other cylinder during a portion of the rotation of said cylinders;

an adhesive member having a first surface attached to the lead end of the replenishing web and a second opposed surface removeably attached to said second tape retaining arrangement of said second cylinder;

an anvil moveable between a first position in spaced relation from said cylinders and a second position between and in closely spaced relation to said first and second cylinders; and a drive arrangement coupled to said first and second cylinders and to said anvil for rotationally displacing said first and second cylinders about their respective axes and displacing said anvil between said first and second positions in a timed manner so as to position said adhesive member and the attached end of the replenishing web in contact with a first surface of the depleting web while moving the first cutting element of said first cylinder into engagement with the depleting web in severing the depleting web while simultaneously moving the anvil to said second position so as to be positioned between the first surface of the depleting web and the replenishing web, wherein said first cutting element engages said anvil after severing the depleting web in forming a splice between the replenishing web and the depleting web without stopping the replenishing web and the depleting web.

2. The continuous splicer apparatus of claim 1 further comprising first and second protuberances disposed respectively on the surfaces of said first and second cylinders adjacent the first and second cutting elements, respectively, for engaging and urging the depleting web into intimate contact with said adhesive member and said second cylinder on which the first replenishing web is positioned prior to cutting of the depleting web.

3. The continuous splicer apparatus of claim 2, wherein each of said protuberances is comprised of an elastomer.

4. The continuous splicer apparatus of claim 3, wherein said protuberances are on the order of ⅛ inch thick.

5. The continuous splicer apparatus of claim 1, wherein said each of said first and second cylinders includes respective first and second opposed flat portions extending the length of the cylinder to provide clearance for the first replenishing web, the depleting web and said anvil between the cylinders during rotation and to reduce the axial moment of inertia of the cylinders.

6. The continuous splicer apparatus of claim 1 further comprising a web accumulator adapted to receive the spliced first depleting web and replenishing web and to provide the spliced webs to web consuming machinery on a non-interrupted, continuous basis.

7. The continuous splicer apparatus of claim 6, wherein said web accumulator includes thin wall rollers with low friction bearings for handling the spliced web.

8. The continuous splicer apparatus of claim 6, wherein said web accumulator includes air bars for directing compressed air onto the spliced web for reducing friction on the spliced web.

9. The continuous splicer apparatus of claim 6, wherein the spliced depleting web and replenishing web are fed to and provided from said accumulator at a relatively constant rate, at a rapidly changing rate or at a cyclic dynamic rate.

10. The continuous splicer apparatus of claim 6 further comprising first and second web supply rolls for providing the depleting web and the replenishing web.

11. The continuous splicer apparatus of claim 10 further comprising a controller coupled to said accumulator and to said first and second web supply rolls and responsive to the rate at which the spliced web is provided by said accumulator to said web consuming machinery for reducing web tension variation and the possibility of damaging or tearing a web.

12. The continuous splicer apparatus of claim 1 further comprising first plural idler rollers engaging the depleting web and second plural rollers engaging the first replenishing web for providing mirror image web runs for said depleting web and said first replenishing web for allowing said first and second cylinders to handle the depleting and replenishing webs in an alternating manner in providing spliced webs in a non-stop manner.

13. The continuous splicer apparatus of claim 1, wherein each of said tape retaining arrangements is vacuum actuated.

14. The continuous splicer apparatus of claim 13, wherein each tape retaining arrangement includes a vacuum manifold disposed in a peripheral portion of an associated cylinder and connected to a vacuum source.

15. The continuous splicer apparatus of claim 14, wherein each tape retaining arrangement further includes an elastomeric layer disposed on the peripheral portion of an associated cylinder and in contact with a respective web.

16. The continuous splicer apparatus of claim 1 further comprising an idler roller engaging and forming a loop in said first replenishing web prior to cutting of the depleting web to facilitate splicing of the first replenishing web to the depleting web.

17. The continuous splicer apparatus of claim 1 further comprising a sensor for detecting an end of the depleting web for performing web splicing automatically.

18. The continuous splicer apparatus of claim 1 further comprising an actuator responsive to a control input from an operator for performing web splicing semi-automatically.

19. The continuous splicer apparatus of claim 1 further comprising an operator responsive control mechanism coupled to said second cylinder for initiating rotation of said second cylinder and splicing of the first replenishing web to the depleting web.

20. The continuous splicer apparatus of claim 1, wherein said drive arrangement includes a drive mechanism coupled to said anvil and to said first and second cylinders for positioning said anvil in said first position and said first and second cylinders in standby rotational positions in preparation for initiating splicing of the webs.

21. The continuous splicer apparatus of claim 1 further comprising sensors coupled to said drive arrangement, to the first replenishing web or to the depleting web for sensing movement of the first replenishing web or the depleting web and triggering an alert when web movement is not consistent with splicing the first replenishing web to the depleting web.

22. The continuous splicer apparatus of claim 1, wherein said cutting elements are elongated, linear blades.

23. The continuous splicer apparatus of claim 1, wherein said drive arrangement includes timing gears, drive gears and a manual input mechanism for an operator for manual operation or a controller and drive for automatic operation.

24. The continuous splicer apparatus of claim 1 further comprising first and second plural magnets disposed in a spaced manner along the lengths of, and on the respective outer peripheries of, said first and second cylinders for engaging and retaining said anvil along the lengths thereof for maintaining said anvil in contact with a replenishing web on one of said cylinders during rotation of said cylinders, said drive arrangement including a retractor assembly coupled to said anvil for displacing said anvil from said first position to said second position prior to severing of the depleting web by a cutting element.

25. The continuous splicer apparatus of claim 24, wherein said drive arrangement includes at least one handle coupled to said anvil and adapted for manual engagement and displacement of said anvil from said second position to said first position.

26. The continuous splicer apparatus of claim 1 further comprising first and second raised strips disposed on opposed surfaces of said anvil for increasing the extent of engagement of said anvil with the first replenishing web on said second cylinder and with the depleting web on said first cylinder prior to and during cutting of the depleting web.

27. The continuous splicer apparatus of claim 24 further comprising an lanyard and hook combination coupling said anvil to said retractor assembly.

28. The continuous splicer apparatus of claim 1, wherein said replenishing web is a first replenishing web and said first tape retaining arrangement is adapted for engaging and retaining a second replenishing web by means of a second adhesive member and positioning said second replenishing web in contact with a trailing end of said first replenishing web, and wherein said second cutting element is adapted to sever a trailing end of said first replenishing web in forming a splice between said first and second replenishing webs.

29. A method for splicing a lead end of a replenishing web to a depleting web, said method comprising the steps of:

rotating first and second cylinders having respective first and second parallel central axes, wherein said first and second cylinders are rotated about their respective axes in opposite directions;

positioning first and second cutting elements respectively on first peripheral portions of said first and second cylinders, wherein each first peripheral portion of said cylinders is disposed in closely spaced relation to the other cylinder during a portion of rotation of said cylinders;

positioning first and second tape retaining arrangements on respective second peripheral portions of said first and second cylinders, wherein said second tape retaining arrangement is adapted to engage the replenishing web, and wherein each second peripheral portion of said cylinders is disposed in closely spaced relation to the other cylinder during a portion of rotation of said cylinders;

attaching a first surface of an adhesive member to the lead end of the replenishing web and removeably attaching a second opposed surface of said adhesive member to said second tape retaining arrangement of said second cylinder;

positioning an anvil adjacent to said first and second cylinders, wherein said anvil is moveable between a first position in spaced relation from said cylinders and a second position between and in closely spaced relation to said first and second cylinders; and rotating said first and second cylinders about their respective axes so as to displace the replenishing web and the depleting web and simultaneously displace said anvil between said first and second positions in a timed manner, wherein said adhesive member and the attached lead end of the replenishing web are positioned in contact with a first surface of the depleting web while the first cutting element of said first cylinder is moved into engagement with a second opposed surface of the depleting web in severing the depleting web while simultaneously moving said anvil to said second position so as to be positioned between the first surface of the depleting web and the replenishing web, wherein said first cutting element engages said anvil after severing the depleting web.

* * * * *